United States Patent [19]

Anderson

[11] 4,016,873

[45] Apr. 12, 1977

[54] PNEUMATIC IMPACTER

[76] Inventor: Otis F. Anderson, P.O. Box 723, Winfield, Kans. 67156

[22] Filed: Apr. 1, 1976

[21] Appl. No.: 672,596

[52] U.S. Cl. ..... 128/54; 128/69

[51] Int. Cl.[2] ..... A61H 23/00

[58] Field of Search ..... 128/51, 53, 54, 55, 128/68, 69

[56] References Cited

UNITED STATES PATENTS 2,078,159 4/1937 Redding ..... 128/53 X

FOREIGN PATENTS OR APPLICATIONS 17,826 10/1904 Austria ..... 128/53

8,726 10/1901 United Kingdom ..... 128/53

*Primary Examiner*—Lawrence W. Trapp

*Attorney, Agent, or Firm*—Fishburn, Gold & Litman

[57] ABSTRACT

A pneumatically actuated impact tool, for use by trained personnel in chiropractic treatment of the spine and other parts of the body, includes a resiliently tipped plunger reciprocably mounted in a cylinder having a tank, with a fitting for connection to a source of air under pressure. Air pressure is selectively communicated to the cylinder and thereby to the plunger by a valve mounted in an aperture in a wall separating the tank and the cylinder, and engaged by a valve lever which is pivoted in a handle attached to the tank and to the cylinder. A trigger is pivotally mounted on the handle and has a portion thereof engaging the valve lever, to provide a leverage to open the valve and allow the air pressure into the cylinder to drive the plunger in a single stroke against a compression spring mounted coaxially thereon to impart a desired impact to the patient.

8 Claims, 5 Drawing Figures

PNEUMATIC IMPACTER

The present invention relates to impact instruments for use in adjusting irregularities of the spine and more particularly to such instruments that are pneumatically driven.

Various devices have been disclosed for administering impacts to the vertibrae, for treatment thereof, including spring driven devices and pneumatically driven devices. The spring driven devices require hand setting after each impact, necessitating delays therefor and contributing to the fatigue of the therapist. Spring driven devices are also generally complicated in design, and the springs, over a period of time, are subject to deterioration making controlled impacts difficult to administer precisely. The pneumatically driven impacters are also relatively complicated in design and require relatively complicated resetting procedures.

The principal objects of the present invention are: to provide a pneumatically driven impacter having an impact stroke and power suitable for treating the spine and other parts of the body; to provide such an impacter having a reservoir which is connectible to an external source of compressed air; to provide such an impacter having a one-piece plunger reciprocably mounted in a cylinder and having a resilient tip thereon; to provide such an impacter having a handle located thereon such that the impacter is balanced and easily manipulated; to provide such an impacter which permits precisely controlling the strength of the impact; to provide such an impacter having a positively sealing valve; to provide such an impacter having a lever and trigger for leverage to facilitate overcoming the pressure in the tank and the force of a spring urging the valve to a closed position; to provide such an impacter wherein a single trigger actuation results in a single impact stroke; to provide such an impacter whereby resetting is accomplished by releasing the trigger; to provide such an impacter which is economical to manufacture and use, which is convenient, precise, and durable in operation, and which is particularly well adapted for its intended purpose.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figure 3:
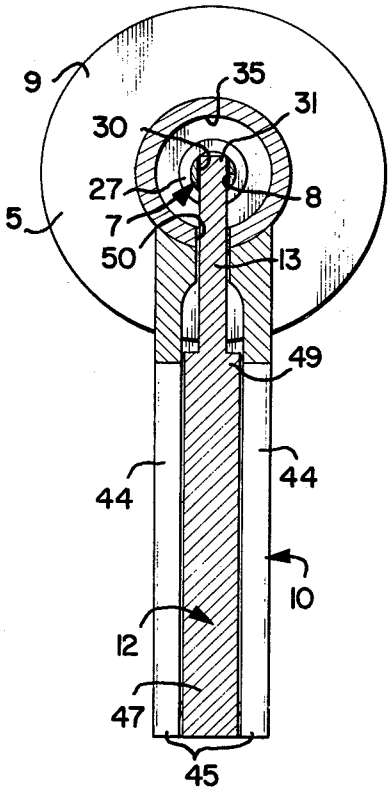
FIG. 3 is a transverse sectional view through the impacter taken on line 3—3, FIG. 2.
Figure 1:
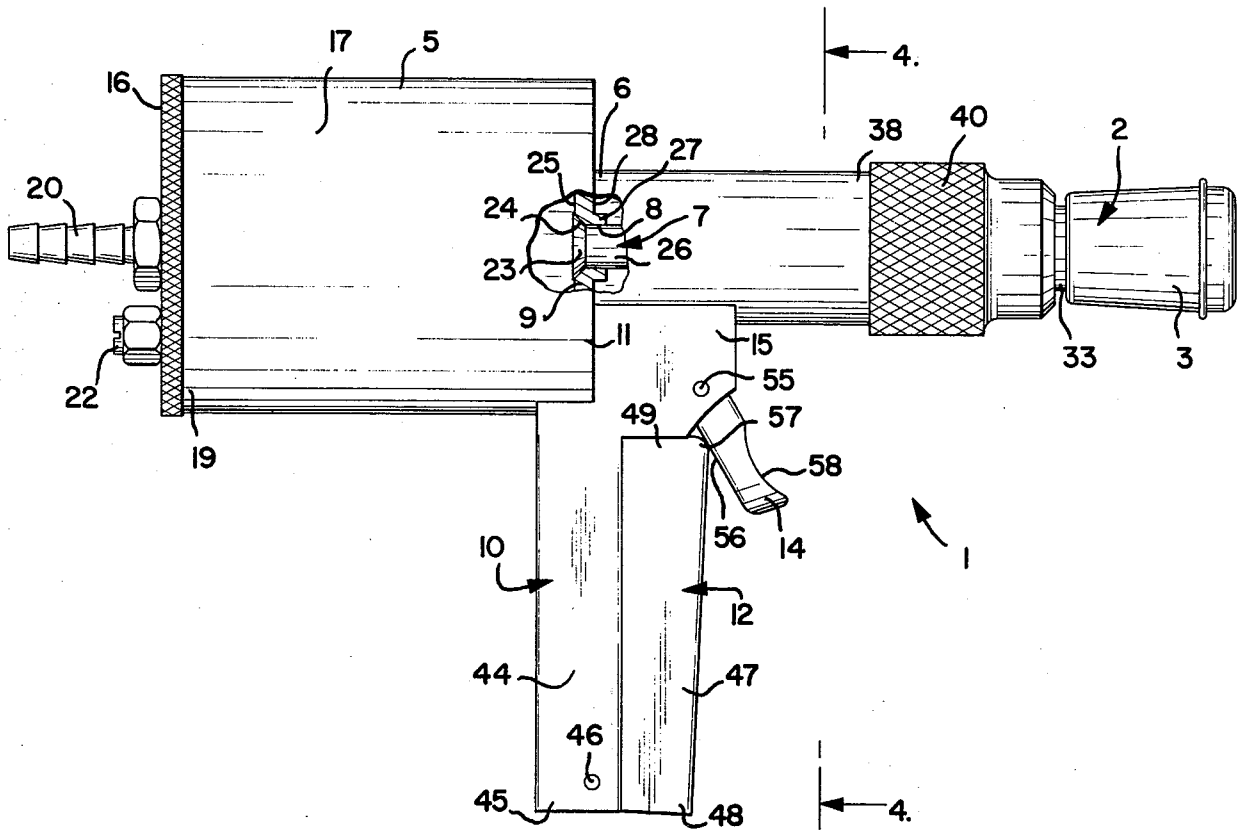
FIG. 1 is a side elevational view of the impacter with portions of the tank and cylinder broken away, and showing the valve seated and the plunger retracted.
Figure 4:
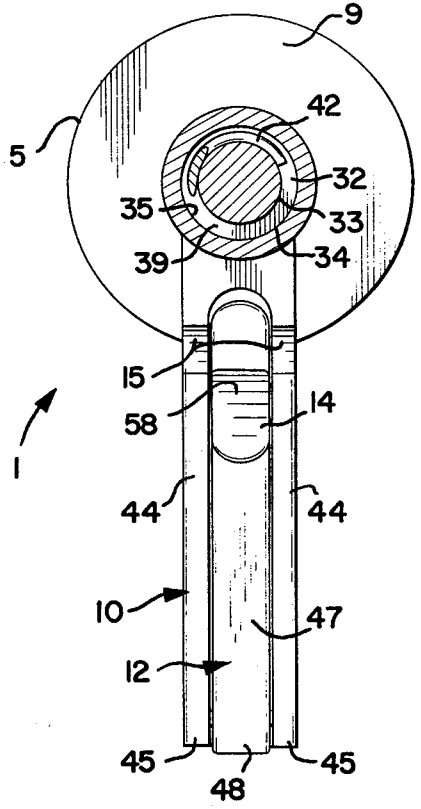
FIG. 4 is a transverse sectional view through the impacter taken on line 4—4, FIG. 1.
Figure 2:
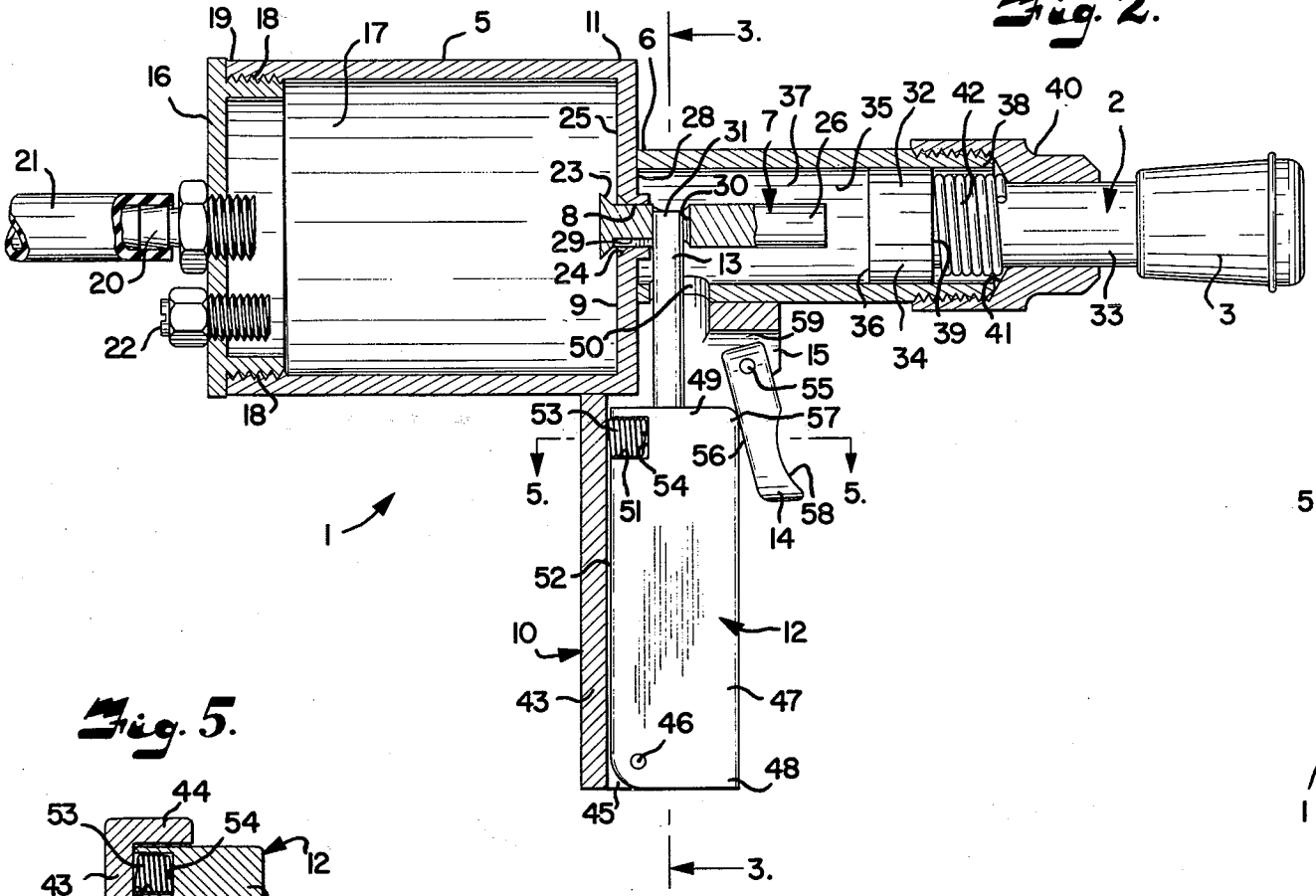
FIG. 2 is a longitudinal sectional view showing the valve open and the plunger extended.
Figure 5:
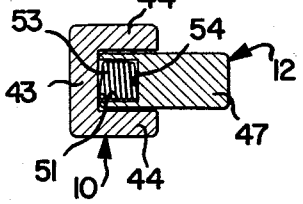
FIG. 5 is a transverse sectional view of the handle of the impacter, taken on line 5—5 of FIG. 2.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring to the drawings in more detail:

The reference numeral 1 generally designates a pneumatically actuated impacter for use by chiropractors and like trained personnel in treating the spine and other parts of the body. The impacter 1 includes a plunger 2 having a resilient tip 3 thereon. The plunger is slidably mounted in a cylinder that is selectively communicated with an air pressure supply to move the plunger and impart a desired impact to a portion of the body of a patient. The structure delivers a single impact in response to a pull of a trigger that opens a valve as the trigger must be released and the valve closed before a second impact may be delivered.

In the structure illustrated the air pressure supply includes a reservoir tank 5 mounted on the rear end 6 of the cylinder 4. A valve 7 is mounted in an aperture 8 formed in a wall 9 of the tank 5. A handle 10 is mounted on the rear end 6 of the cylinder 4 and the front end 11 of tank 5 for gripping the impacter 1 and manipulating same. A valve lever 12 is pivotally mounted on the handle 10 and has a reduced portion or pin 13 engaging the valve 7 for actuation thereof. A trigger 14 is pivotally mounted on forward extensions 15 of the handle 10 for engaging the lever in a manner for increased leverage to facilitate opening the valve 7.

The tank 5 is illustrated as a substantially cylindrical structure with a front wall 9, a rear wall 16, and a cylindrical side wall 17. Preferably, one of the end walls, for example, the rear wall 16 is removable to provide for maintenance access to the tank 5 and valve 7. Therefore, the rear wall 16 is illustrated as being externally threaded on the periphery thereof, as at 18; and the cylindrical wall 17 is provided with mating internal threads adjacent a rear end 19 thereof.

The tank 5 stores air under pressure that is received from a source not shown. The tank 5 is provided with a fitting 20 on the rear wall 16 thereof, the fitting 20 being connected to a hose 21 communicating with a source of air under pressure, such as a compressor (not shown). Since it is contemplated that the impacter 1 will be used in a medical setting, it is preferred that an approved type of air filter (not shown) be included in the hose 21 to insure against contamination of a sterile environment in which the impacter might be used.

It is desirable that the force of impact of the impacter 1 be predictable and relatively precise. Therefore, an adjustable pressure relief valve 22 is included on the tank 5 for regulating the pressure therein. The relief valve 22 is a conventional pressure relief valve of the type which opens when the pressure in the tank 5 exceeds a selected value and closes when the pressure drops below that value. The relief valve 22 is illustrated as being mounted on the rear wall 16 of the tank 5.

The valve 7 may be any suitable, linearly translatable type of gas valve and is illustrated as having a frusto-conical surface 23 and being mounted for sealing engagement with the frusto-conical valve seat 24 formed on the tank side 25 of the front tank wall 9 at the aperture 8 thereof. The valve 7 has an elongated, forwardly projecting stem 26 which is sized for sliding clearance in the aperture 8. It is preferred that an annular boss 27 be formed around the aperture 8 on the cylinder side 28 of the tank wall 9 to provide the valve stem 26 with adequate support for proper seating of the valve 7. A flow passage 29 is formed on the peripheral surface of the valve stem 26 to communicate air under pressure from the tank 5 to the cylinder 4 when the valve 7 is in an open position. The size of the passage 29 is determined by considering the geometry of the cylinder 4 and plunger 5, the service pressure of the compressed air supply (not shown), and the strength of the impact desired. An opening or recess 30 is formed in the valve stem 26 to receive an end 31 of the valve lever pin 13 as later described.

The cylinder 4 is a tubular member having the rear end 6 thereof joined to the front side 28 of the front tank wall 9, as by welding or by being integral therewith. The plunger 2 is an elongated member that is slidably mounted in the cylinder 4 for reciprocal movement therein. The plunger 2 has a piston portion 32 and a shank portion 33 with the piston 32 having an exterior cylindrical surface 34 for sliding contact with the interior cylindrical surface 35 of the cylinder 4. The piston 32 has a rear end surface 36 which, together with the cylindrical surface 35 and the tank wall surface 28, forms an expansion chamber 37. Pressurization of the expansion chamber 37 propels the plunger 2 toward the front end 38 of the cylinder 4.

The diameter of the shank portion 33 is smaller than that of the piston 32 whereby a first annular shoulder 39 separates the piston 32 and the shank 33. The external surface of the cylinder 4 is threaded adjacent the front end 38 thereof to receive an internally threaded cap 40 which has a second annular shoulder 41 in facing relation with the first annular shoulder 39 when the cap 40 is installed on the cylinder 4. A compression recoil spring 42 is sleeved onto the shank 33 before installation of the cap 40. The spring has opposite ends respectively engaging the first and second annular surfaces 39 and 41. Whereas pressurization of the chamber 37 tends to propel the plunger 2 out of the cylinder 4, the cooperation of the spring 42 and the annular shoulders 39 and 41 returns the plunger 2 to its starting position. The resilient tip 3 cushions the impact upon the patient receiving treatment, the tip 3, being similar to the type that is employed on walking canes, crutches and the like, is pressed onto the free end of the plunger 2 for a frictional fit after the cap 40 has been installed.

The handle 10 is mounted radially to the cylinder 4 and the tank 5 and at a longitudinal position such that the impacter 1 has a comfortable balance. The handle 10 provides a grip for the impacter 1, facilitating manipulation thereof, and also provides a mount for the valve lever 12. The illustrated handle 10 is channel shaped in cross section having an end web 43 and laterally spaced, forwardly extending flanges 44. The flanges 44 have aligned apertures formed adjacent lower ends 45 thereof to receive a pivot pin 46. The valve lever 12 has a body portion 47 positioned between the flanges 44 with a pivot pin receiving aperture adjacent a lower end 48 thereof whereby the valve lever 12 pivots on the pivot pin 46.

The pin portion 13 of the valve lever 12 projects from the upper end 49 of the body portion 47 and extends through a slot 50 formed in the wall of the cylinder 4 into the opening 30 to engage the valve stem 26. A recess 51 is formed on the rear side 52 of the body 47, and a compression return spring 53 is positioned therein with opposite ends engaging respectively an end surface 54 of the recess and the web 43 of the handle 10.

Pivoting the valve lever 12 toward the tank 2 opens the valve 7, whereas the return spring 53 urges the valve lever 12 away from the tank 2, causing the valve 7 to close upon release of the valve lever 12. To facilitate pivoting of the valve lever 12, the trigger 14 is employed to apply leverage thereto. Pivot pin receiving apertures are formed in the extensions 15 of the flanges 44 of the handle 10 and in one end of the trigger 14. The trigger 14 is mounted for pivotal movement about a pivot pin 55 on the extensions 15. The trigger 14 has a surface 56 engaging a corner 57 of the upper body end 49. The trigger 14 is a lever with the pivot pin 55 serving as a fulcrum with said trigger having a contoured area 58 to provide a comfortable grip for the therapist.

The impacter 1 is designed for one-shot operation, that is, one complete impact stroke results from one trigger pull. Therefore, exhaust passages are provided for conducting air from the cylinder after each impact stroke. Immediately subsequent to opening the valve 7, the expansion chamber 37 fills with air under pressure, the bulk of which is expended in propelling the plunger 2 forwardly. As the trigger 14 is released, the valve 7 closes, and the recoil spring 42 urges the plunger 2 back to its starting position. As the plunger 2 returns, the excess air is forced out of the contracting expansion chamber 37 through the slot 50 in the cylinder 4 and out through an exhaust passage 59 in the handle 10 immediately above the trigger 14.

Use of the impacter 1 is straight forward. A hose 21 from a source of compressed air (not shown) is connected to the fitting 20. Preferably an approved type of air filter (not shown) is included in the air line. The pressure relief valve 22 is adjusted for the desired pressure within the tank 2. The area of treatment on the patient is located; the impacter 1 is positioned; and the trigger 14 is pulled. A single impact stroke results.

Failure to release the trigger 14 will not result in multiple impacts, since it is necessary for the plunger 2 to return to its starting position and for the recoil spring 42 to relax before the next impact can be actuated.

While the impacter 1 is designed primarily for treatment of conditions of the vertibrae known as sublaxations, it may also find application in massaging or otherwise treating the muscles of the legs and shoulders, the feet and other parts of the body.

It is to be understood that although certain forms of this invention have been illustrated and described, it is not to be limited thereto except insofar as such limitations are included in the following claims.

What I claim and desire to secure by Letters Patent is:

1. A pneumatically actuated impacter for use in chiropractic therapy comprising:

a. a reservoir for containing compressed air, said reservoir having a fitting removably connectible to a source of compressed air and an adjustable pressure relief valve for regulating the pressure therein;

b. a hollow cylinder mounted on said reservoir, extending therefrom, and terminating in a front end having an axial opening therethrough, said cylinder having a cylinder annular shoulder formed in said opening at said front end facing said reservoir;

c. a plunger reciprocably mounted in said cylinder, said plunger having a piston at one end, a shank portion extending through said axial opening, and an impact end remote from said piston end, said impact end having a resilient cap thereon, and said plunger having a plunger annular shoulder between said piston and said shank portion, said plunger shoulder facing said cylinder shoulder;

d. a recoil spring sleeved onto said shank portion with respective opposite ends engaging said cylinder and said plunger shoulders, said recoil spring urging said plunger toward said reservoir;

e. a channel shaped handle member having a central web extending laterally outwardly from said cylinder and reservoir, and having spaced apart, parallel flanges extending toward said cylinder front end;

f. a wall separating said reservoir from said cylinder, said wall having a flow aperture therethrough, said aperture having a valve seat formed on the reservoir side thereof;

g. a linearly translatable valve member having a head portion seatable on said valve seat and an elongated stem extending toward said front end, said stem being in close sliding contact with said flow aperture walls and having a flow passage formed thereon for communicating compressed air from said reservoir to said cylinder;

h. an elongated valve lever pivotally mounted on said handle and having one end engaging said valve stem to translate said valve from a seated position to an unseated position;

i. a trigger member pivotally mounted on said handle and having a surface engaging said valve lever to facilitate pivoting thereof; and j. a return spring positioned between said valve lever and said handle to normally urge said valve lever to retain said valve head in a seated position.

2. A pneumatically actuated impacter for use in chiropractic therapy comprising:

a. a reservoir for containing compressed air;

b. a hollow cylinder mounted on the reservoir, extending therefrom, and terminating in a front end remote from said reservoir, said cylinder having an axial opening at said front end;

c. a wall separating said reservoir from said cylinder;

d. said wall having a flow aperture therethrough, said aperture having a valve seat formed on the reservoir side thereof;

e. a plunger reciprocably mounted in said cylinder and having a portion extending through said axial opening and terminating in an impact end;

f. resilient means in the cylinder urging said plunger toward said reservoir;

g. a handle member extending laterally outwardly from said reservoir and cylinder;

h. valve means controlling communication between said reservoir and said cylinder;

i. valve lever means on said handle operative to actuate said valve means for supplying air pressure to said cylinder to move said plunger therein and provide an impact;

j. said valve means being a linearly translatable valve member havng a head portion sealingly engageable with said valve seat; and k. said valve head having an elongated valve stem projecting therefrom toward said cylinder front end, said stem having a recess engaged in said valve lever means for translating said valve member along the longitudinal axis of said stem.

3. The impacter as set forth in claim 2 wherein:

a. said valve lever means comprises an elongated valve lever having one end engaging said valve means; and b. said valve lever is pivotally mounted on said handle member whereby said valve means is moved between seated position and an unseated position in response to selective pivoting of said valve lever.

4. The impacter as set forth in claim 2 wherein:

a. said plunger has a resilient cap on said impact end, a piston on the other end, and a shank therebetween;

b. a first annular shoulder is formed on said plunger between said piston and said shank;

c. said cylinder has a second annular shoulder formed at said front end, said first and second shoulders being in mutually facing relation;

d. said resilient means is a recoil spring sleeved onto said shank, with respective opposite ends of said recoil spring engaging said first and said second shoulders.

5. The impacter as set forth in claim 2 wherein:

a. said valve stem has a peripheral surface in close sliding contact with said aperture; and b. said valve stem peripheral surface has a flow passage formed thereinto for communicating said compressed air from said reservoir to said cylinder when said valve means is unseated.

6. A pneumatically actuated impacter for use in chiropractic therapy comprising:

a. a reservoir for containing compressed air;

b. a hollow cylinder mounted on the reservoir, extending therefrom, and terminating in a front end remote from said reservoir, said cylinder having an axial opening at said front end;

c. a plunger reciprocably mounted in said cylinder and having a portion extending through said axial opening and terminating in an impact end;

d. resilient means in the cylinder urging said plunger toward said reservoir;

e. a handle member extending laterally outward from said reservoir and cylinder;

f. valve means controlling communication between said reservoir and said cylinder;

g. valve lever means on said handle operative to actuate said valve means for supplying air pressure to said cylinder to move said plunger therein and provide an impact;

h. a trigger member pivotally mounted on said handle member, said trigger member being a lever engaging said valve lever means to facilitate actuation of said valve means;

i. said handle member being a channel shaped member having a central web extending laterally outward from said reservoir and said cylinder, and having spaced apart parallel flanges extending toward said cylinder front end; and j. said valve lever means being pivotally mounted between said flanges.

7. The impacter as set forth in claim 6 wherein a return spring is positioned with opposite ends thereof engaging said handle member and said valve lever means for normally retaining said valve means in a seated position.

8. A pneumatically actuated impacter for use in chiropractic therapy comprising:

a. a reservoir for containing compressed air;

b. a hollow cylinder mounted on the reservoir, extending therefrom, and terminating in a front end remote from said reservoir, said cylinder having an axial opening at said front end;

c. a plunger reciprocably mounted in said cylinder and having a portion extending through said axial opening and terminating in an impact end;

d. resilient means in the cylinder urging said plunger toward said reservoir;

e. a handle member extending laterally outward from said reservoir and cylinder;

f. a flow passage communicating said reservoir with the cylinder in spaced relation to said plunger, said flow passage having a portion with a valve seat;

g. valve means having a head portion sealingly engageable with said valve seat and an elongated stem extending from said head portion, said valve means controlling communication between said reservoir and said cylinder; and h. valve lever means pivotally mounted on said handle member and having an end portion operatively engaged with said valve means stem for moving said valve means between seated position and unseated position in response to selective pivoting of said valve lever means, said unseating of the valve means effecting a supply of air pressure to the cylinder to move said plunger therein and provide an impact.

* * * * *